United States Patent [19]

Chance

[11] Patent Number: 4,464,079

[45] Date of Patent: Aug. 7, 1984

[54] IRRIGATION SYSTEM

[76] Inventor: James M. Chance, 1741 N. Gilbert Ave., Casa Grande, Ariz. 85222

[21] Appl. No.: 512,627

[22] Filed: Jul. 11, 1983

[51] Int. Cl.[3] ..... E02B 13/00

[52] U.S. Cl. ..... 405/37; 405/36

[58] Field of Search ..... 405/36–38, 405/87; 251/305, 306; 137/236

[56] References Cited

U.S. PATENT DOCUMENTS 3,408,818 11/1968 Hemphill ..... 405/37
3,918,264 11/1975 Bradshaw ..... 405/37
3,952,522 4/1976 Shettel ..... 405/37

FOREIGN PATENT DOCUMENTS 499378 3/1976 U.S.S.R. ..... 405/37

*Primary Examiner*—Dennis L. Taylor
*Attorney, Agent, or Firm*—Drummond & Nissle

[57] ABSTRACT

An improved irrigation system. The irrigation system includes a primary canal, a secondary canal having enclosed ends such that a flow of water entering the secondary canal accumulates therein and eventually overflows unless a sufficient volume of water is removed from the secondary canal, a water metering unit for diverting water from the primary canal to the secondary canal, siphons for transferring water from the secondary canal to a field adjacent the canal, and apparatus for monitoring the level of water in the secondary canal and activating an alarm when water in the secondary canal rises past a selected level.

2 Claims, 2 Drawing Figures

IRRIGATION SYSTEM

Figure 1:
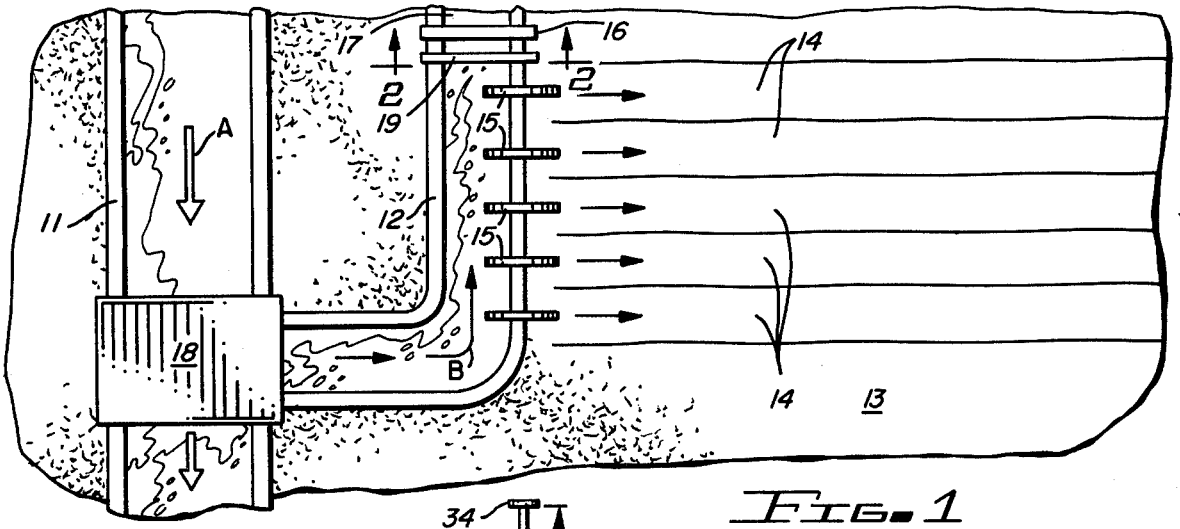

This invention relates to irrigation systems.

More particularly, the invention relates to irrigation systems including a primary canal, a secondary canal having generally enclosed ends such that water flowing into the secondary canal accumulates and eventually overflows from the canal unless a sufficient volume of water is removed therefrom, a water metering control unit for diverting a flow of water from the primary to the secondary canal, apparatus for directing water from the secondary canal into a plurality of furrows in a field adjacent the secondary canal in sufficient volume to prevent the secondary canal from filling and overflowing, and, alarm apparatus which alerts an individual when water is directed from the primary canal into the secondary canal at a rate faster than the rate at which water is drawn from the secondary canal into furrows adjacent the canal.

In another respect, the invention pertains to an irrigation system of the type described in which the alarm apparatus permits an individual to monitor the rate of flow of water from the primary to the secondary canal after he has left the area to attend to other tasks.

In a further respect, the invention pertains to an irrigation system of the type described in which the alarm apparatus can be readily positioned at any of a plurality of points along the length of the secondary canal.

In irrigation systems found in the American Southwest and other desert regions, a flow of water from a large primary canal is directed into secondary canals which run along the edge of fields to be irrigated. Water flows to the primary canal from a reservoir or from other canals interconnecting the primary canal with the reservoir or other source of water. Curved siphon tubes or other water transfer apparatus draw water from each secondary canal and direct it into furrows traversing the fields adjacent the canal. A water metering control unit is used to direct water from the primary canal into each secondary canal at the desired rate of flow. The siphon tubes remove water from a secondary canal at a rate generally equivalent to the rate of flow of water into the secondary canal from the primary canal. Ordinarily there are a number of farms located along the primary canal, each farm having at least several secondary canals which draw water from the primary canal.

When the irrigation system described above is utilized, each secondary canal must be continually monitored because when a farmer upstream stops withdrawing water from the primary canal, the rate of flow of water through the primary canal increases, causing a concomitant increase in the rate of flow of water from the primary canal into downstream secondary canals. The increased rate of flow of water into downstream secondary canals will cause the secondary canals to fill and overflow unless the individuals monitoring these canals decrease the rate of flow of water from the primary canal into the secondary canals.

When a secondary canal overflows, the banks of the canal quickly erode, especially if the canal banks are earthen. If the canal has concrete walls, overflowing water erodes supporting earth away from the concrete walls, causing the walls to collapse. Since repairing a concrete canal costs approximately four to five dollars a foot, the cost incurred in attempting to repair a length of canal can quickly become prohibitive.

Further, when a secondary canal overflows and is damaged, the time required to repair the ditch may result in crop losses. During hot summer weather, an entire crop can be lost unless a damaged secondary canal is repaired within one or two days. Even if a damaged canal is repaired in time to save a crop, the crop may have been without water for a long enough period of time to have reached a point of stress where it began to drop fruit, resulting in partial crop loss.

In order to avoid the overflow of and damage to a secondary canal, it is presently the practice to assign at least one individual to monitor each secondary canal being supplied with water from a primary irrigation canal. This practice accounts for the substantial personnel costs associated with irrigation. These personnel costs could be greatly reduced if an individual could, after initially adjusting the flow of water from the primary to the secondary canal, leave the area to attend to adjusting the flow of water from the primary canal into other secondary canals.

Accordingly, it would be highly desirable to develop an irrigation system of the type described which would permit an individual after adjusting the flow of water from a primary to a secondary canal to leave the area and attend to the completion of other tasks.

It would also be highly desirable to develop an irrigation system which would greatly minimize the likelihood that a secondary canal would fill and overflow when there was an increase in the rate of flow of water through the primary canal feeding the secondary canal.

Therefore, it is a principle object of the invention to provide an improved irrigation system.

A further object of the instant invention is to provide an improved irrigation system of the type including a primary canal, a secondary canal having generally enclosed ends such that water flowing into the secondary canal accumulates and eventually overflows from the canal unless a sufficient volume of water is removed therefrom, a water metering control unit for diverting a flow of water from the primary to the secondary canal, apparatus for directing water from the secondary canal into a plurality of furrows in a field adjacent the secondary canal in sufficient volume to prevent the secondary canal from filling and overflowing, and, alarm apparatus which alerts an individual when water is directed from the primary canal into the secondary canal at a rate faster then the rate at which water is drawn from the secondary canal into furrows adjacent the canal.

A further object of the instant invention is to provide an improved irrigation system of the type described which permits an individual to operate several primary-secondary canal combinations simultaneously.

Still another object of the invention is to provide an improved irrigation system of the type noted which minimizes the probability that the secondary canal will fill and overflow when the flow rate of water in the primary canal increases.

Yet another object of the invention is to provide an improved irrigation system of the type described which can be readily positioned at and removed from various locations along the secondary canal and which detects when the level of water in the secondary canal rises above a selected level.

Figure 2:
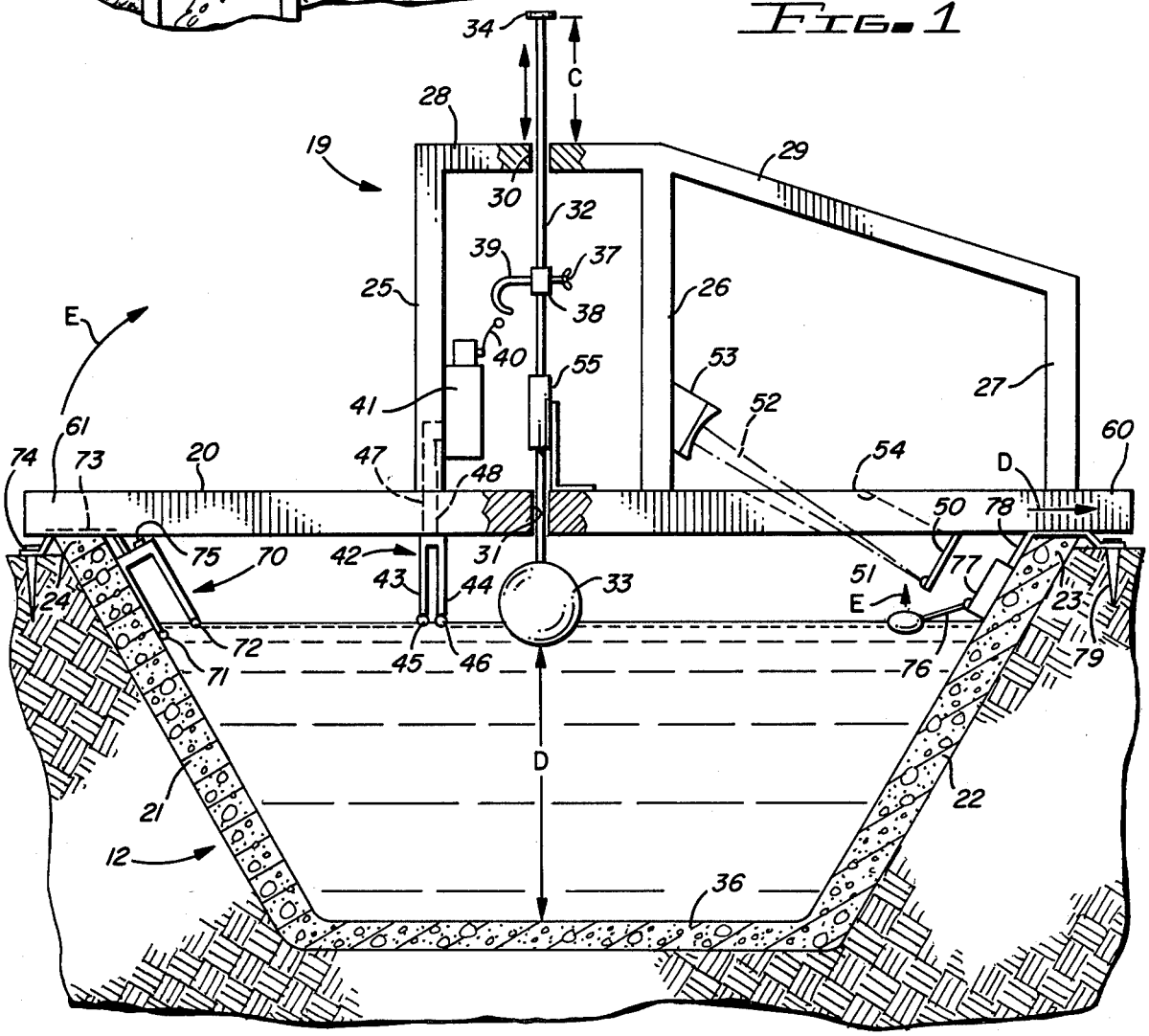

These and other further and more specific objects and advantages of the invention will be apparent to those skilled in the art from the following detailed description thereof, taken in conjunction with the drawings, in which:

FIG. 1 is a schematic plan view of an irrigation system designed in accordance with the principles of the invention; and, FIG. 2 is a front elevation view of alarm apparatus utilized in the operation of the primary and secondary canal of the irrigation system of FIG. 1.

Briefly, in accordance with my invention, I provide an improved irrigation system. The system includes a primary canal having water traveling therethrough at a first rate of flow; a secondary canal having generally enclosed ends such that a flow of water entering said secondary canal accumulates therein and eventually overflows the canal unless a sufficient volume of water is removed therefrom; means for diverting water from the primary canal to the secondary canal at a selected second rate of flow, the second rate of flow through the diverting means into the secondary canal increasing when the rate of flow of water through the primary canal increases from the first rate of flow of water therethrough; means for transferring water from the secondary canal into a field adjacent the secondary canal, the transferring means removing water from the secondary canal at a rate generally equivalent to the second rate of flow of water into the secondary canal such that the secondary canal is prevented from filling and overflowing; and, means for monitoring the level of water in the secondary canal such that an alarm is activated when the rate of flow of water through the primary canal increases beyond the first rate of flow, the increased rate of flow of water through the primary canal causes the rate of flow of water into the secondary canal to therefore increase to a flow rate greater than the second flow rate, causes the rate of flow of water through the transferring means into the field to therefore be less than the increased rate of flow of water into the second canal, and permits the water level in the secondary canal to rise past a selected level. The monitoring means includes an elongate member adapted to span the secondary canal, alarm means, and means carried on the elongate member for detecting when the water level in the canal rises above a selected level and for activating the alarm means when the water level in the canal rises above the selected level.

Turning now to the drawings, which depict the presently preferred embodiments of the invention for the purpose of illustrating the practice thereof and not by way of limitation of the scope of the invention, and in which like reference characters identify corresponding elements throughout the several views, FIG. 1 illustrates an irrigation system constructed in accordance with the principles of the invention and including a primary canal 11, secondary canal 12, field 13 with furrows 14, and siphon tubes 15 transferring water from secondary canal 12 into furrows 14 of field 13. Water flows through primary canal 11 in the direction of arrow A and through secondary canal 12 in the direction of arrow B. Stop gate 16 positioned in canal 12 prevents water from passing through gate 16 into portion 17 of canal 12 positioned upstream of gate 16. Water metering control unit 18 diverts water from primary canal 11 into secondary canal 12. Water moves through primary canal 11 at a first rate of flow and is diverted through control unit 18 into secondary canal 12 at a desired second rate of flow. The first rate of flow in cubic feet of water per minute is generally greater than the second rate of flow in cubic feet of water per minute. The rate of flow of water through control unit 18 into secondary canal 12 is generally equivalent to the rate of flow of water withdrawn from canal 12 through siphons 15 into field 13. Control unit 18 is constructed such that as the rate of flow of water through primary canal 11 increases, the rate of flow of water through unit 18 into secondary canal 12 also increases. Control unit 18 could be constructed to maintain the rate of flow of water into the secondary canal 12 at a fixed rate regardless of increases or decreases in the rate of flow of water through primary canal 11.

Primary canal 11 typically passes through a number of farms and water is simultaneously withdrawn from canal 11 by a plurality of farmers. If, after the rate of flow of water from primary canal 11 through unit 18 to secondary canal 12 has been initially set, one or more farmers upstream of the primary canal section shown in FIG. 1 stop withdrawing water from primary canal 11, then the rate of flow of water through primary canal 11 will increase. When the rate of flow of water through primary canal 11 increases, then the rate of flow of water through control 18 into secondary canal 12 also increases. Since siphons 15 only remove water from canal 12 at a rate generally equivalent to the rate of flow of water which was initially entering canal 12 before the rate of flow of water through canal 11 increased, canal 12 begins to fill and will eventually overflow unless control unit 18 is adjusted to reduce the increased rate of flow of water through unit 18 into secondary canal 12. Since the rate of flow of water through canal 11 can quickly increase and consequently cause canal 12 to rapidly fill and overflow, it is presently necessary to provide an individual continually to monitor the rate of flow of water through canal 11 and into secondary canal 12.

Alarm apparatus 19 used in connection with the primary-secondary canal system of FIG. 1 is illustrated in FIG. 2 and includes elongate beam 20 spanning and resting on the upper edges 23, 24 of walls 21, 22 of canal 12. The ends of beam 20 could rest on the ground adjacent walls 21, 22 of canal 12. Beam 20 supports an upstanding substantially rigid frame including vertically disposed beams 25, 26, 27, horizontal beam 28 attached to beams 25 and 26, and, sloped beam 29 interconnecting beams 26, 27. Apertures 30, 31 in beams 28, 20 slidably receive elongate rod 32. One end of rod 32 is fixedly attached to float 33 while the other end is connected to coinshaped, horizontally oriented member 34. Member 34 is sized such that it cannot pass through aperture 30 and therefore prevents float 33 from falling any further than the distance indicated by arrows C. Distance C is generally less than distance, indicated by arrows D, from float 33 to bottom 36 of canal 12 in FIG. 2. When set screw 37 is loosened sleeve 38 can be slidably displaced along rod 32. Set screw 37 is tightened to fix sleeve 38 and outwardly projecting J-shaped member 39 in the desired position on rod 32. The position of sleeve 38 on rod 32 determines at what water level or what position of float 33 J-shaped member 39 contacts and upwardly displaces switch 40 to the position shown in FIG. 2. When switch 40 is in the position shown in FIG. 2, then alarm unit 41 is activated. Unit 41 can include any conventional alarm means, including a siren, flashing light, or, a transmitter which activates a beeper unit carried by the individual in charge of monitoring the irrigation system of FIG. 1.

When the canal water level shown in FIG. 2 drops to a sufficiently low level, float 33 moves downwardly and J-shaped member 39 contacts and moves switch 40 to its second operative downwardly displaced position. In its second operative position, switch 40 deactivates alarm unit 41.

Apparatus 19 is provided with alternate means for detecting when the water level in ditch 12 has reached or risen above a selected level. In particular, electrical switch 42 includes arms 43, 44 having sensors 45, 46. When the water level reaches sensors 45, 46 as illustrated in FIG. 2, electricity flows across the sensors and serves to close switch 42 so that electricity flows down a wire 47, across sensors 45, 46 and back up wire 48 to unit 41. When electricity flows across sensors 45, 46 an alarm in unit 41 is activated. If sensor switch 42 were utilized in place of float 33 and the support structure associated with float 33, apparatus 19 would be minimal weight and could be readily positioned across canal 12. A battery for powering switch 42 could be stored in unit 41.

Similarly, a light optics system could be mounted on beam 20 and include arm 50 carrying bulb 51 emitting beam 52 received by detector 53. When the water in ditch 12 reaches a high enough level it envelops bulb 51 and prevents beam 52 from reaching detector 53. Detector 53 is operatively associated with alarm unit 41 such that detector 53 activates alarm unit 41 when water envelops bulb 51 and breaks beam 52. In order to avoid the possibility of water contacting and shorting wiring associated with bulb 51, bulb 51 could be the end of a fiber optic strand. Beam 52 passes through an aperture formed in beam 20 and represented by dashed lines 54 in FIG. 2. Bulb 51 is powered by a battery in unit 41 or by any other suitable means.

In use, control unit 18 is adjusted so that the rate of flow of water through unit 18 into secondary canal 12 is generally equivalent to the rate at which siphons 15 withdraw water from canal 12 into field 13. If the rate of flow of water from primary canal 11 into secondary canal 12 is generally equivalent to the rate at which siphons 15 withdraw water from canal 12, then the level of water in canal 12 is relatively stable. After the level of water in canal 12 has stabilized at the desired level, or the water level vascillates within an acceptable range, float 33 is lowered onto the surface of the water in canal 12, set screw 37 is loosened and sleeve 38 moved along rod 32 so member 39 is the desired distance below switch 40. Set screw 37 is tightened to secure sleeve 38 in this position. Switch 40 is in its second operative downward "off" position when set screw 37 is tightened to secure sleeve 38 in position on rod 32. If, after sleeve 38 is tightened in position on rod 32 below switch 40, the water level in the ditch rises enough to upwardly displace float 33 and member 39 and, consequently, to upwardly displace switch 40 to the position shown in FIG. 1, then alarm unit 41 is activated.

As earlier noted, float 33 and rod 32 could be removed from apparatus 19 and electrode switch unit 42 utilized to determine when the water level in ditch 12 has risen to a selected level. Arms 43, 44 of switch 42 can be adjustable so electrodes 45, 46 can be positioned at varying heights below beam 20 and above the normal water level of ditch 12. Arm 50 of detector 53 can be designed so bulb 51 can be positioned at varying levels below beam 20 and above the normal water level of ditch 12.

Sleeve 55 is internally threaded and receives the upper externally threaded end of the portion of rod 32 spanning the distance between sleeve 55 and float 33. Sleeve 55 also rotatably receives the lower externally threaded end of the portion of rod 32 above sleeve 55. Sleeve 55 permits rod 32 to be quickly disassembled.

Water flow control unit 18 can be designed so that when the water level in ditch 12 exceeds a selected level and activates alarm 41, an electromagnetic signal from unit 41 commands unit 18 to operate a valve or other mechanism to automatically reduce the rate of flow of water from canal 11 into canal 12. The microcircuit and computer technology necessary to construct this type of alarm 14-control unit 18 system is well known in the art. Such a system would permit apparatus 19 to continually coordinate with control unit 18 to monitor the water level in ditch 12 and appropriately adjust the flow of water through control unit 18 into secondary canal 12.

Gate 16 can be positioned along canal 12 at any preferred location. Apparatus 19 can be positioned along canal 12 at any preferred location spanning a portion of canal 12 containing water transferred through siphon 15 into field 13.

As shown in FIG. 2, beam 20 is essentially at ground level. Handle 29 is positioned a distance above beam 20 which allows an individual standing next to canal 12 to lift apparatus 19 from above the canal and to move apparatus 19 over to the side of canal 12 without having to bend over or without having to grasp an end 60 of beam 20 and drag the beam in the direction of arrow D in FIG. 2. As a result, handle 29 permits apparatus 19 to be removed from above canal 12 without any portions of apparatus 19 falling into and contacting the water in the canal. If electrical apparatus is utilized in alarm unit 41 it is usually important that the unit not contact water contained in ditch 12.

By stepping on end 60 and grasping and upwardly lifting handle 29, end 61 of apparatus 19 is upwardly displaced in the direction of arrow E so that removal of apparatus 19 from over canal 12 is further facilitated.

In an alternate embodiment of the invention, switch 70, generally identical to switch 42, is maintained against the upper part of wall 21 of canal 12 by cable 73 attached to stake 74 driven in the ground adjacent canal 12. Cable 73 can be anchored by any available means other than stake 74. When the water level of canal 12 rises to a point where water covers electrodes 71, 72 as shown in FIG. 2, switch 70 closes and transmitter 75 begins to operate. When transmitter 75 is operating, it activates an alarm unit positioned on the bank of the canal, on switch 70, or at any other desired location.

In still another alternate embodiment of the invention, switch unit 77 is maintained against the upper part of wall 22 of canal 12 by cable 78 anchored to stake 79. As the water in canal 12 rises, it upwardly displaces float arm 76 in the direction of arrow E. When arm 76 has been displaced a sufficient amount in direction E, it closes a switch in unit 77, causing unit 77 to send a signal to an alarm unit which is carried in unit 77, setting on the bank of canal 12, or positioned at any other desired location.

Any acceptable means other than cables 73, 78 may be utilized to maintain units 70, 77 in position against walls 21, 22 of canal 12.

A cable spanning canal 12 could be attached to switch 42 and utilized in place of beam 20 to maintain switch 42 in the position shown in FIG. 2. If switch 42 were suspended from such a cable, alarm unit 41 could also be carried on the cable, be placed on the ground at the side of canal 12, or, be positioned at any other desired location.

Having described my invention in such terms as to enable those skilled in the art to understand and practice it, and having identified the presently preferred embodiments thereof, I claim:

1. An irrigation system including (a) a primary canal having water traveling therethrough at a first rate of flow;

(b) a secondary canal having generally enclosed ends such that a flow of water entering said secondary canal accumulates therein and eventially overflows said canal unless a sufficient volume of said water is removed therefrom;

(c) means for diverting water from said primary canal to said secondary canal at a selected second rate of flow, said second rate of flow through said diverting means into said secondary canal increasing when the rate of flow of water through said primary canal increases from said first rate of flow of water therethrough;

(d) means for transferring water from said secondary canal into a field adjacent said secondary canal, said transferring means removing water from said secondary canal at a rate generally equivalent to said second rate of flow of water into said secondary canal such that said secondary canal is prevented from filling and overflowing;

(e) means for monitoring the level of water in said secondary canal such that an alarm is activated when (i) the rate of flow of water through said primary canal increases beyond said first rate of flow, (ii) the rate of flow of water into said secondary canal therefore increases to a rate of flow greater than said second rate of flow, and (iii) said rate of flow of water through said transferring means into said field is therefore less than said increased rate of flow of water into said second canal and permits said water level in said secondary canal to rise past a selected level, said monitoring means including (iv) an elongate member adapted to span said secondary canal, (v) alarm means, and (vi) means carried on said elongate member for detecting when said water level in said canal rises above a selected level and for activating said alarm means when said water level in said canal rises above said selected level.

2. An irrigation system including (a) a primary canal having water traveling therethrough at a first rate of flow;

(b) a secondary canal having generally enclosed ends such that a flow of water entering said secondary canal accumulates therein and eventually overflows said canal unless a sufficient volume of said water is removed therefrom;

(c) means for diverting water from said primary canal to said secondary canal at a selected second rate of flow, said second rate of flow through said diverting means into said secondary canal increasing when the rate of flow of water through said primary canal increases from said first rate of flow of water therethrough;

(d) means for transferring water from said secondary canal into a field adjacent said secondary canal, said transferring means removing water from said secondary canal at a rate generally equivalent to said second rate of flow of water into said secondary canal such that said secondary canal is prevented from filling and overflowing; and (e) means for monitoring the level of water in said secondary canal such that an alarm is activated when (i) the rate of flow of water through said primary canal increases beyond said first rate of flow, (ii) the rate of flow of water into said secondary canal therefore increases to a rate of flow greater than said second rate of flow, and (iii) said rate of flow of water through said transferring means into said field is therefore less than said increased rate of flow of water into said second canal and permits said water level in said secondary canal to rise past a selected level, said monitoring means including (iv) a frame adapted to be maintained in position against the side of said secondary canal, (v) alarm means, and (vi) means carried on said frame for detecting when said water level in said canal rises above a selected level and for activating said alarm means when said water level in said canal rises above said selected level.

* * * * *